US008976959B2

(12) United States Patent
Duplan et al.

(10) Patent No.: US 8,976,959 B2
(45) Date of Patent: Mar. 10, 2015

(54) ECHO DELAY ENCODING

(71) Applicant: Clinkle Corporation, Mountain View, CA (US)

(72) Inventors: Lucas Andrew Duplan, Orinda, CA (US); Jason N. Riggs, Atherton, CA (US)

(73) Assignee: Clinkle Corporation, San Francisco, CA (US)

( * ) Notice: Subject to any disclaimer, the term of this patent is extended or adjusted under 35 U.S.C. 154(b) by 0 days.

(21) Appl. No.: 13/835,577

(22) Filed: Mar. 15, 2013

(65) Prior Publication Data

US 2014/0140503 A1 May 22, 2014

Related U.S. Application Data

(60) Provisional application No. 61/728,949, filed on Nov. 21, 2012.

(51) Int. Cl.
*H04K 1/04* (2006.01)
*H04K 1/02* (2006.01)

(52) U.S. Cl.
CPC ..... *H04K 1/02* (2013.01)
USPC ..... 380/35; 381/22

(58) Field of Classification Search
CPC ..... H04K 1/06; H04K 1/02; H04L 9/00
See application file for complete search history.

(56) References Cited

U.S. PATENT DOCUMENTS

| | | | | |
|---|---|---|---|---|
| 5,307,405 | A | 4/1994 | Sih | |
| 7,860,458 | B2 * | 12/2010 | Mabuchi | 455/41.2 |
| 8,255,323 | B1 | 8/2012 | Casey et al. | |
| 8,396,808 | B2 | 3/2013 | Greenspan | |
| 8,514,662 | B2 * | 8/2013 | Paulson | 367/135 |
| 8,577,045 | B2 * | 11/2013 | Gibbs | 381/23 |
| 2005/0086163 | A1 | 4/2005 | Johnson et al. | |
| 2007/0022058 | A1 | 1/2007 | Labrou et al. | |
| 2007/0150826 | A1 | 6/2007 | Anzures et al. | |
| 2008/0114699 | A1 | 5/2008 | Yuan et al. | |
| 2010/0106647 | A1 | 4/2010 | Raman | |
| 2010/0145860 | A1 | 6/2010 | Pelegero | |
| 2011/0029416 | A1 | 2/2011 | Greenspan | |
| 2011/0156863 | A1 | 6/2011 | Dirksen et al. | |
| 2012/0051187 | A1 | 3/2012 | Paulson | |
| 2012/0089461 | A1 | 4/2012 | Greenspan | |
| 2012/0179525 | A1 | 7/2012 | Seguin et al. | |
| 2012/0281841 | A1 * | 11/2012 | Kim et al. | 381/22 |

OTHER PUBLICATIONS

MG Siegler "MobilePay May Be the Death of the Wallet. Yes, for Real This Time", TechCrunch article, Sep. 28, 2010, http://techcrunch.com/2010/09/28/mobilepayusa/.

Mark Hachman "MobilePay: Your Phone Is Your Credit Card", pcmag.com article, Sep. 28, 2010, http://www.pcmag.com/article2/0,2817,2369877,00.asp.

* cited by examiner

*Primary Examiner* — Fikremariam A Yalew
(74) *Attorney, Agent, or Firm* — Van Pelt, Yi & James LLP

(57) ABSTRACT

Communicating data is disclosed. A time delay encoding a data to be communicated is selected. A sonic signal is combined with a version of the sonic signal that is delayed by the selected time delay. The data is communicated at least in part by transmitting the combined signal to a mobile device.

20 Claims, 13 Drawing Sheets

ECHO DELAY ENCODING

CROSS REFERENCE TO OTHER APPLICATIONS

This application claims priority to U.S. Provisional Patent Application No. 61/728,949 entitled ULTRASONIC DATA TRANSFER filed Nov. 21, 2012 which is incorporated herein by reference for all purposes.

BACKGROUND OF THE INVENTION

Secure near-field communications generally require specialized communication hardware configured to broadcast information according to specified communication protocols. Such specialized hardware is generally not included in mobile phones and similar mobile devices, and requires very specific communicative functionalities not otherwise available to mobile devices. Thus, to use a mobile device to communicate using such specified protocols requires add-on specialized communication hardware. For instance, the communication hardware add-on can couple to a USB port on a mobile device, can broadcast and receive near-field communications, and can provide such near-field communications to the mobile device via the USB port.

Mobile devices are increasingly used to conduct financial transactions. For instance, a user of a mobile device may wish to pay for coffee at a coffee shop with the mobile device. As discussed above, the near-field communications required for such a transaction generally requires additional specialized communication hardware, which can be expensive and inconvenient to use. Accordingly, the ability for a mobile device to perform secure near-field communications without the use of specialized hardware can reduce the costs and simplify the process of using a mobile device to conduct financial transactions.

BRIEF DESCRIPTION OF THE DRAWINGS

Various embodiments of the invention are disclosed in the following detailed description and the accompanying drawings.

DETAILED DESCRIPTION

The invention can be implemented in numerous ways, including as a process; an apparatus; a system; a composition of matter; a computer program product embodied on a computer readable storage medium; and/or a processor, such as a processor configured to execute instructions stored on and/or provided by a memory coupled to the processor. In this specification, these implementations, or any other form that the invention may take, may be referred to as techniques. In general, the order of the steps of disclosed processes may be altered within the scope of the invention. Unless stated otherwise, a component such as a processor or a memory described as being configured to perform a task may be implemented as a general component that is temporarily configured to perform the task at a given time or a specific component that is manufactured to perform the task. As used herein, the term 'processor' refers to one or more devices, circuits, and/or processing cores configured to process data, such as computer program instructions.

A detailed description of one or more embodiments of the invention is provided below along with accompanying figures that illustrate the principles of the invention. The invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

Encoding data by varying delay between signals is disclosed. In some embodiments, a time delay is selected to encode data to be communicated. For example, a transmission signal includes a delay encoded signal that combines multiples copies of the same sonic (e.g., audio) signal, and each copy of the same sonic signal may be delayed relative to each other by a time delay amount that corresponds to a data to be communicated. In some embodiments, the transmission signal to be transmitted includes a plurality of frequency communication channels that can be used to transmit different data and each communication channel includes a delay encoded signal within the frequency band of the channel. In some embodiments, a receiver of the signal, such as a mobile device, receives the transmitted signal and for each frequency channel included in the signal, autocorrelates the signal in the channel to determine the delay encoded in the signal. The determined delays may be mapped to the data desired to be communicated.

Figure 1A:
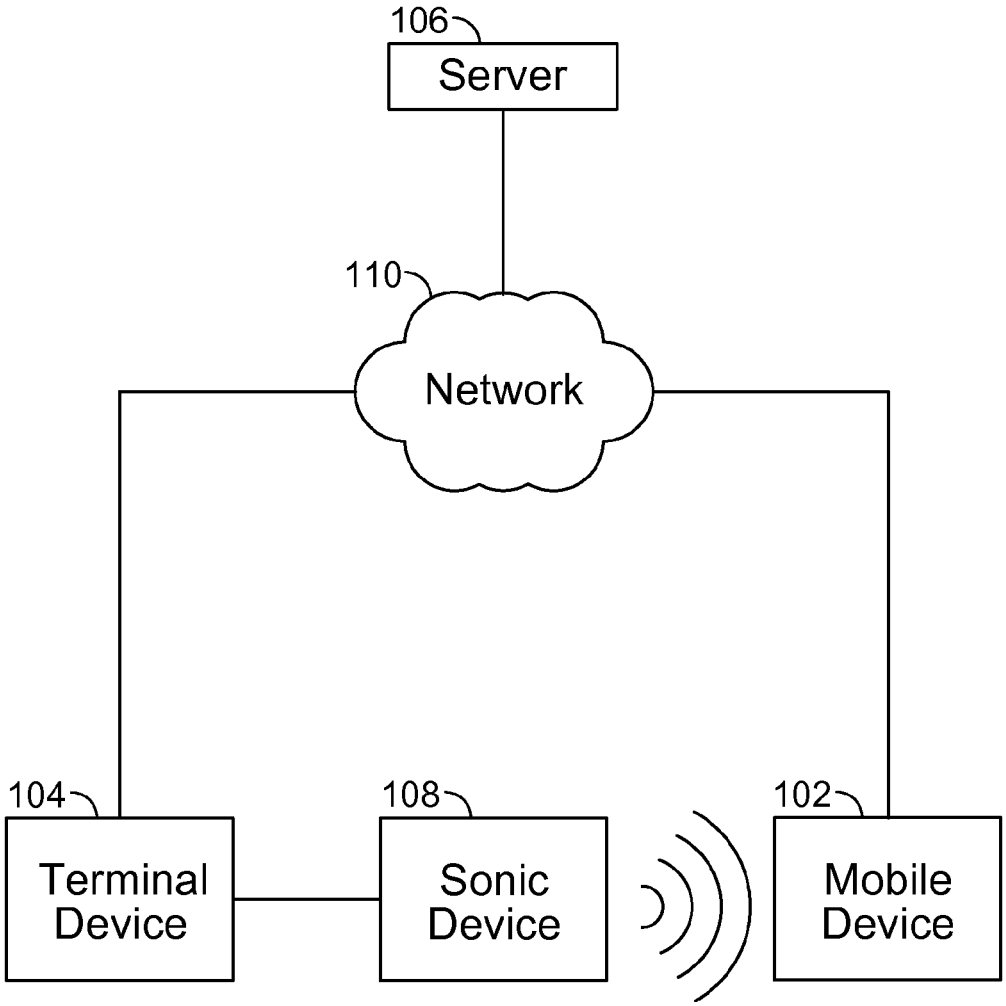
FIG. 1A is a block diagram illustrating an embodiment of a system for transferring information.

FIG. 1A is a block diagram illustrating an embodiment of a system for transferring information. Mobile device 102, terminal device 104, and server 106 are connected to network 110. Terminal device 104 is connected to sonic device 108. The connections shown in FIG. 1A may be wired and/or wireless connections. For example, network 110 includes a cellular data/internet network and mobile device 102 communicates with network 110 via a wireless cellular connection. In another example, terminal device 104 connects with network 110 via a WIFI connection and/or cellular connection. In another example, server 106 connects with network 110 via a wired connection. The connection between terminal device 104 and sonic device 108 may also be wired or wireless. For example, terminal device 104 and sonic device 108 are connected via a wired cable (e.g., an audio cable connected to headphone jack port of terminal device 104 or a data cable connected to data cable port of device 104). In another example, terminal device 104 and sonic device 108 are connected wirelessly (e.g., Bluetooth (R) wireless connection, WIFI connection, etc.). In some embodiments, terminal device 104 performs the function of sonic device 108 and sonic device 108 may be optional. In some embodiments, sonic device 108 includes a speaker that can be used to transmit a sonic signal and/or emit audio. For example, terminal device 104 may not include a speaker sufficiently powerful and/or movable to effectively transmit a sonic signal. In some embodiments, sonic device 108 includes a microphone that can be used to receive a sonic signal and/or detect audio.

In some embodiments, terminal device 104 may be used as a point of sale device and device 104 initiates a financial transaction. For example, a clerk using terminal device 104 inputs items to be purchased into terminal device 104 to generate an electronic invoice. In some embodiments, when mobile device 102 is within range of sonic device 108 and/or terminal device 104, mobile device 102 receives the electronic invoice via a microphone on mobile device 102, a sonic signal transmitted by sonic device 108 and/or terminal device 104. The mobile device may be able to authorize payment of the electronic invoice by transmitting (e.g., using a sonic and/or radio frequency signal) an authorization to server 106 via network 110 and/or to terminal device 104 and/or sonic device 108 (e.g., terminal device 104 forwards the authorization to server 106). Server 106 processes the authorization to facilitate crediting and debiting of appropriate financial accounts to complete the financial transaction. In some embodiments, server 106 can be any computerized device that can be used to facilitate a transaction between terminal device 104 and mobile device 102, such as a computer run by a financial institution, credit card company, or other business or private entity. In some embodiments, server 106 executes instructions to facilitate the transmission of transaction information between terminal device 104 and mobile device 102.

In some embodiments, terminal device 104 and/or sonic device 108 is configured to transmit data in one-way audio/sonic wave broadcasts to the mobile device 102 using an ultrasonic data transfer scheme. In some embodiments, mobile device 102 is accordingly configured to receive the audio/sonic wave broadcasts and decode the received broadcasts to obtain the transmitted data. The described ultrasonic data transfer scheme may beneficially result in a secure transfer of data at an improved performance relative to various other near-field data transfer techniques. The data transfer scheme may also beneficially help reduce the effect of ambient noise received by the mobile device. It should be noted that although the transmitting of integers is described in many examples, other forms of data, for instance alphanumeric characters and floating point numbers, can be transmitted using the sonic data transfer scheme described herein.

In some embodiments, sonic device 108 and/or terminal device 104 broadcasts using a speaker a sonic signal (e.g., ultrasonic signal) that identifies terminal device 104. For example, the sonic signal encodes an identifier assigned a location, an account, and/or device of terminal device 104 and/or sonic device 108. For example, terminal device 104 and sonic device 108 are located in a retail environment and terminal device 104 broadcasts an identifier assigned to a point of sales device of the retail environment.

In some embodiments, a time delay is selected to encode data to be communicated. For example, a transmission signal includes a delay encoded signal that combines multiples copies of the same sonic (e.g., audio) signal, and each copy of the same sonic signal may be delayed relative to each other by a time delay amount that corresponds to a data to be communicated. In some embodiments, the transmission signal to be transmitted includes a plurality of frequency communication channels that can be used to transmit different data and each communication channel includes a delay encoded signal within the frequency band of the channel. In some embodiments, a receiver of the signal, such as a mobile device, receives the transmitted signal and for each frequency channel included in the signal, autocorrelates the signal in the channel to determine the delay encoded in the signal. The determined delays may be mapped to the data desired to be communicated.

In some embodiments, when mobile device 102 is within range of sonic device 108 and/or terminal device 104, mobile device 102 receives a sonic signal used to determine an identifier associated with sonic device 108 and/or terminal device 104. Mobile device 102 provides the identifier to server 106, and server 106 becomes aware that mobile device 102 is near terminal device 104 and/or sonic device 108. When a clerk using terminal device 104 inputs items to be purchased into terminal device 104 to generate an electronic invoice, the electronic invoice is provided to server 106 by terminal device 104. Because server 106 is aware that mobile device 102 is near terminal device 104, server 106 provides the electronic receipt to mobile device 102 via network 110. Mobile device 102 may be able to authorize payment of the electronic invoice by transmitting (e.g., using sonic and/or radio frequency signal) an authorization to server 106 via network 110 and/or to terminal device 104 and/or sonic device 108 (e.g., terminal device 104 forwards the authorization to server 106). Server 106 processes the authorization to facilitate crediting and debiting of appropriate financial accounts to complete the financial transaction.

In some embodiments, mobile device 102 includes an application such as an Apple iOS application or a Google Android operating system application. For example, a user of the application associates the user's account with the application. The user's account includes information on one or more of the user's financial accounts. For example, information regarding a user's credit card account, bank account, debit card account, and electronic payment account is stored in the user's account. A user may use the application to transfer funds between these financial accounts. Information such as current balance, transaction history, and credit limits may be provided by the application. A user may use the application to authorize payment from one or more of the user's financial accounts. In some embodiments, the application of mobile device 102 facilitates interaction with terminal device 104 and server 106. For example, the application receives the sonic signal and provides an identifier encoded in the signal to server 106. When an electronic invoice is ready for a user of the mobile device to review, server 106 sends the invoice to the application and the application displays the invoice for approval. The user may approve or cancel the electronic invoice using a user interface gesture. In another example, a user uses the application to initiate a payment to another user. The user may enter details about the payee, the amount, and a payment note/message and confirm or cancel the payment using a user interface gesture.

Mobile device 102, terminal device 104, and sonic device 108 may include one or more of the following components: a speaker, a microphone, an analog to digital signal converter, a digital to analog signal converter, a signal filter, a digital signal processor, a processor, a buffer, a signal adder, a signal generator, a transmitter, a receiver, a signal delayer, and a signal correlator. Examples of mobile device 102 include a smartphone, a tablet computer, a media player, a laptop, and another portable computer device. Examples of terminal device 104 include a point of sale device, a desktop computer, a tablet computer, a smartphone, a laptop computer, a computer kiosk, and any other mobile device or computer device. Examples of server 106 include any computer, device, storage, database, and/or communication device that can send, receive, and/or process data. Examples of network 110 include one or more of the following: a direct or indirect physical communication connection, mobile communication network, a cellular network, Internet, intranet, Local Area Network, Wide Area Network, Storage Area Network, and any other form of connecting two or more systems, components, or storage devices together. In various embodiments, the components shown in FIG. 1A may exist in various combinations of hardware machines. For example, terminal device 104 and sonic device 108 may be included in the same device. Other communication paths may exist and the example of FIG. 1A has been simplified to illustrate the example clearly. For example, network components such as a router or a mesh network may be used to communicate via network 110. Although single instances of components have been shown to simplify the diagram, additional instances of any of the components shown in FIG. 1A may exist. For example, multiple mobile devices and multiple terminal devices with sonic devices may be communicating with multiple servers. Components not shown in FIG. 1A may also exist.

Figure 1B:
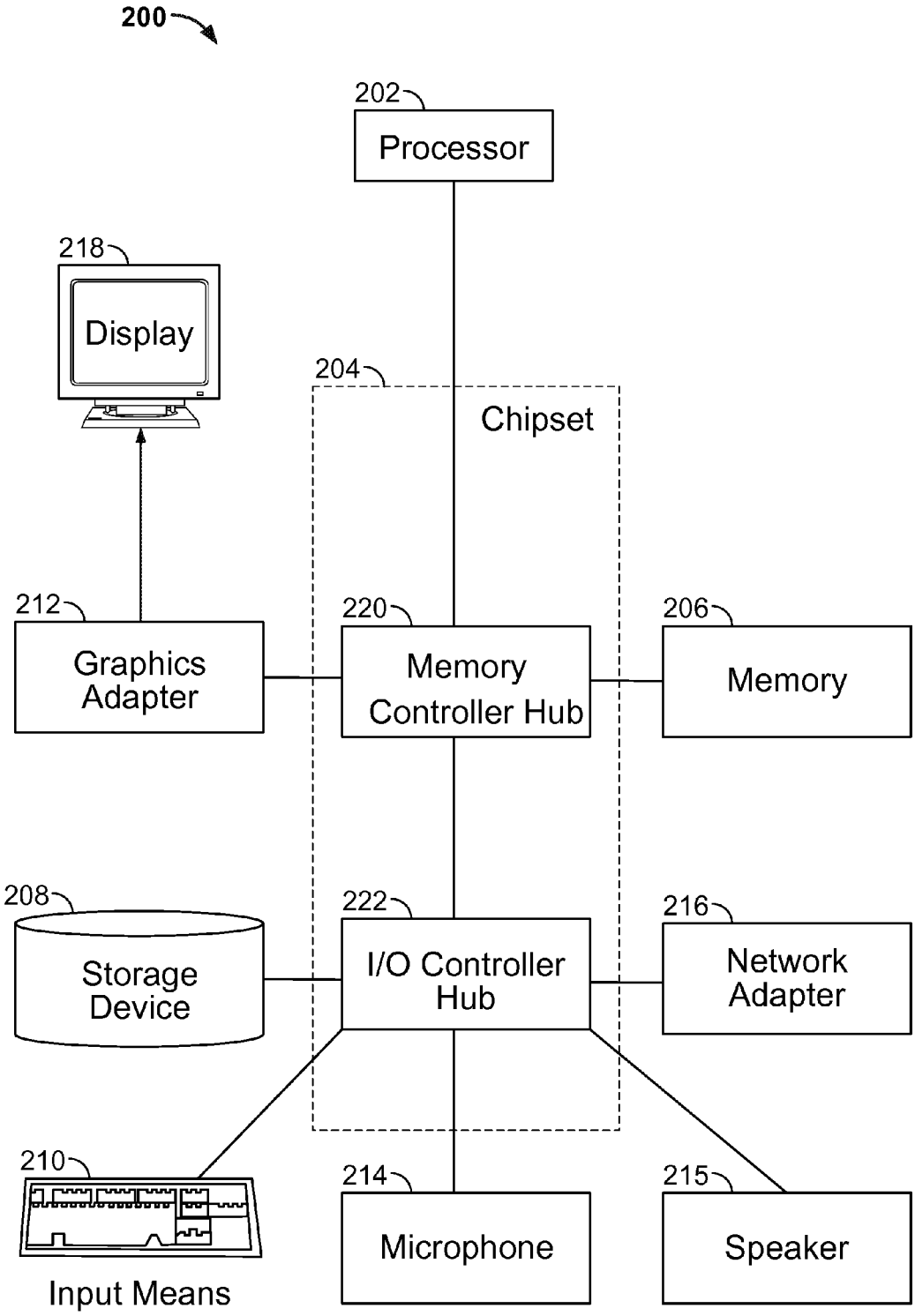
FIG. 1B is a block diagram illustrating an example of a computer.

FIG. 1B is a block diagram illustrating an example of a computer. One or more components of computer 200 may be included in mobile device 102, terminal device 104, server 106, and/or sonic device 108. Although referred to as a "computer" herein, the computer of the embodiment of FIG. 1B can be a mobile device such as a mobile phone, a laptop computer, a tablet computer, and the like; or a non-mobile device such as a desktop computer, a server, a database, a cash register, a payment terminal, and the like.

The computer 200 includes processor 202 coupled to a chipset 204. The chipset 204 includes a memory controller hub 220 and an input/output (I/O) controller hub 222. A memory 206 and a graphics adapter 212 are coupled to the memory controller hub 220, and a display 218 is coupled to the graphics adapter 212. A storage device 208, input means 210, a microphone 214, at least one speaker 215, and network adapter 216 are coupled to the I/O controller hub 222. Other embodiments of the computer have different architectures. For example, the memory can be directly coupled to the processor in some embodiments.

The storage device 208 is a non-transitory computer-readable storage medium such as a hard drive, compact disk read-only memory (CD-ROM), DVD, solid-state memory device, or a magnetic tape drive. The storage device can also include multiple instances of the media, such as an array of hard drives or a magnetic tape changer in communication with a library of magnetic tapes. The memory 206 holds instructions and data used and executed by the processor 202. The instructions include processor-executable instructions configured to cause the processor to perform one or more of the functionalities described herein.

The input means 210 can be a keypad, a keyboard, a mouse, or any other means configured to receive inputs from a user of the computer 200. In some embodiments, the input means and the display are integrated into a single component, for instance in embodiments where the display is a touch-sensitive display configured to receive touch inputs from a user of the computer. In these embodiments, the input means can include a virtual board or other interface configured to receive touch inputs from the user on the display. For example, in embodiments where the computer is a mobile phone, the display of the phone may display a virtual keyboard, and a user can use the virtual keyboard to enter inputs to the computer. The graphics adapter 212 displays images and other information on the display device 218.

The microphone 214 is configured to receive audio signals as inputs and to communicate such inputs to the I/O controller hub. The at least one speaker 215 is configured to broadcast audio signals as outputs. The network adapter 216 is configured to communicatively couple the computer 200 to a network, such as a 3G/4G mobile phone network, a WIFI network, a local area network (LAN), the internet, or any other network, or another computer, such as a mobile device. Some embodiments of the computer have different and/or other components than those shown in FIG. 1B.

The computer 200 is adapted to execute computer program modules for providing functionality described herein. As used herein, the term "module" refers to computer program instructions and other logic used to provide the specified functionality. Thus, a module can be implemented in hardware, firmware, and/or software. In one embodiment, program modules formed of executable computer program instructions are stored on the storage device 208, loaded into the memory 206, and executed by the processor 202.

FIGS. 2A-2D are diagrams illustrating an example data transmission. In some embodiments, data transmission between two devices (sender 2, which is equipped with a speaker, and a receiver 4, which is equipped with a microphone) that utilizes sonic/acoustic data transmission for device recognition and an out-of-band server 6 for primary data transfer is shown. The out-of-band connection with the server 6 can be over a cellular wireless telephone connection or a WIFI connection. This data transmission protocol may include a setup phase, a transmit phase, a receive phase, and an acknowledge phase. For example, the data transmission protocol according to one embodiment can include a setup phase for a transmission protocol, a transmit phase where the first device (sender 2) transmits identification information to the second device (receiver 4), a reception phase where the second device (receiver 4) receives the identification information, and an acknowledgement phase. In some embodiments, sender 2 of FIGS. 2A-2D is included in terminal device 104 and/or sonic device 108 of FIG. 1A. In some embodiments, receiver 4 of FIGS. 2A-2D is included in mobile device 102 of FIG. 1A. In some embodiments, server 6 of FIGS. 2A-2D is included in server 106 of FIG. 1A.

Figure 2A:
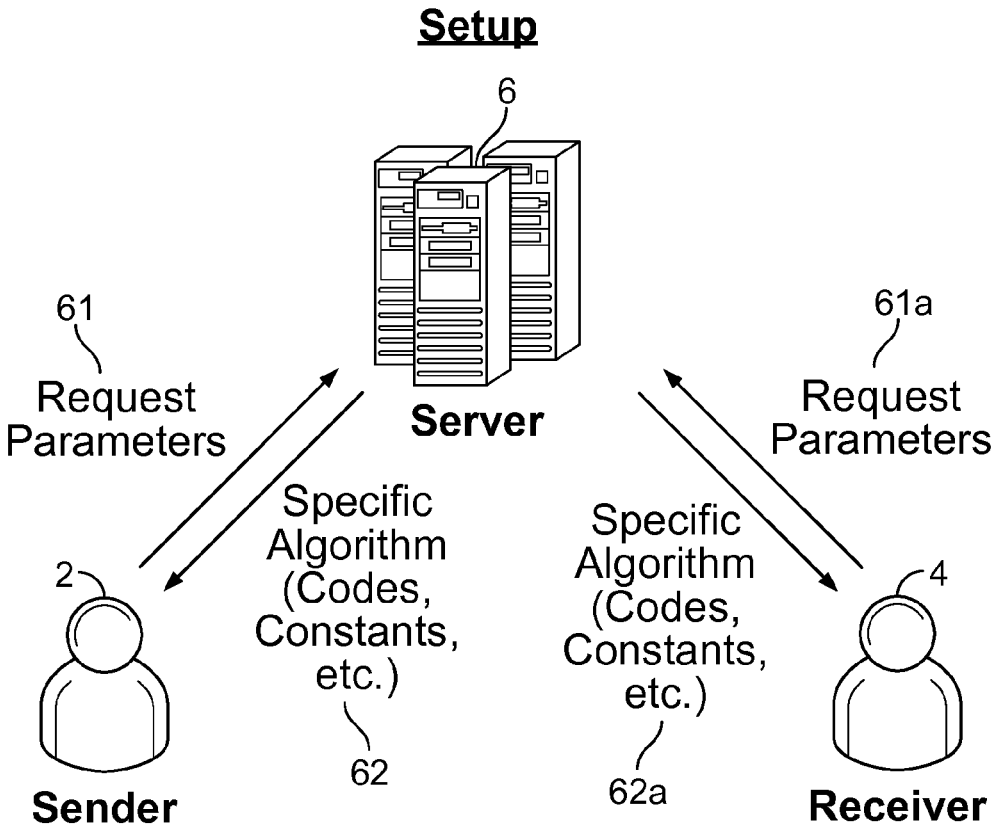
FIGS. 2A-2D are diagrams illustrating an example data transmission.

Referring to FIG. 2A, during the setup phase, sender 2 and receiver 4 pull a transmission protocol from the server 6, as described in greater detail in the following sections. For example, one implementation includes one default transmission protocol, but it is not limited to a particular transmission protocol or a particular implementation of that protocol. During this phase, the sender 2 and receiver 4 agree to a transmission protocol that specifies transmit and receive algorithms and codes to be used. Accordingly, in FIG. 2A, the sender 2 and the receiver 4 both request parameters for the transmission/reception protocol in steps 61, 61*a*. In steps 62, 62*a*, the server 6 delivers a specific transmission/reception protocol to the sender 2 and the receiver 4. The specific transmission/reception protocol can include the instructions to be used for transmission, constants specifying a unique data encoding method, and other information for transmission and reception.

Figure 2B:
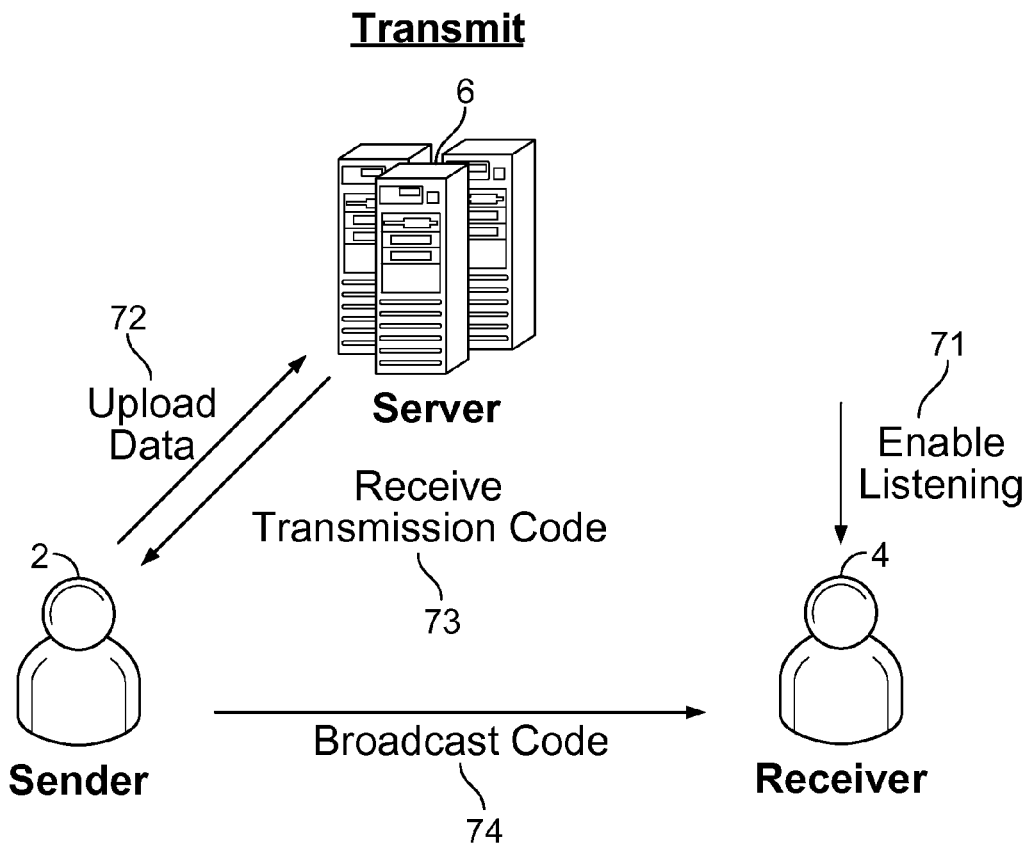

Referring to FIG. 2B, during the transmit phase, information can be exchanged. At the beginning of the transmit phase, the sender 2 sets the appropriate volume setting on its speaker so that it can transmit its identification to the receiver 4. The receiver, in step 71, enables listening so that it can detect the signal transmitted by the sender 2. As set forth above, the receiver 4 can use its microphone to receive the signal from the sender 2. In step 72, the sender 2 uploads the data to the server 6 so that the data can ultimately be delivered to the receiver 4. Next, in step 73, the sender 2 can receive a particular transmission code from the server 6 to be used for the exchange of information. The sender 2 then broadcasts an identification signal as specified by the transmission protocol in step 74. As previously noted in step 71, the receiver 4 listens through its microphone for valid identification signals from the sender 2. Accordingly, the receiver 4 can receive the signal broadcast by the sender 2.

As noted above, the sender 2 can use its speaker to broadcast the identification signals. In addition, the identification signals can be broadcast as within an ultrasonic frequency band. In addition, the receiver 4 can use its microphone to receive the signal from the sender 2. Accordingly, no special hardware is needed aside from that which is present in a typical smart phone or tablet computer.

Figure 2C:
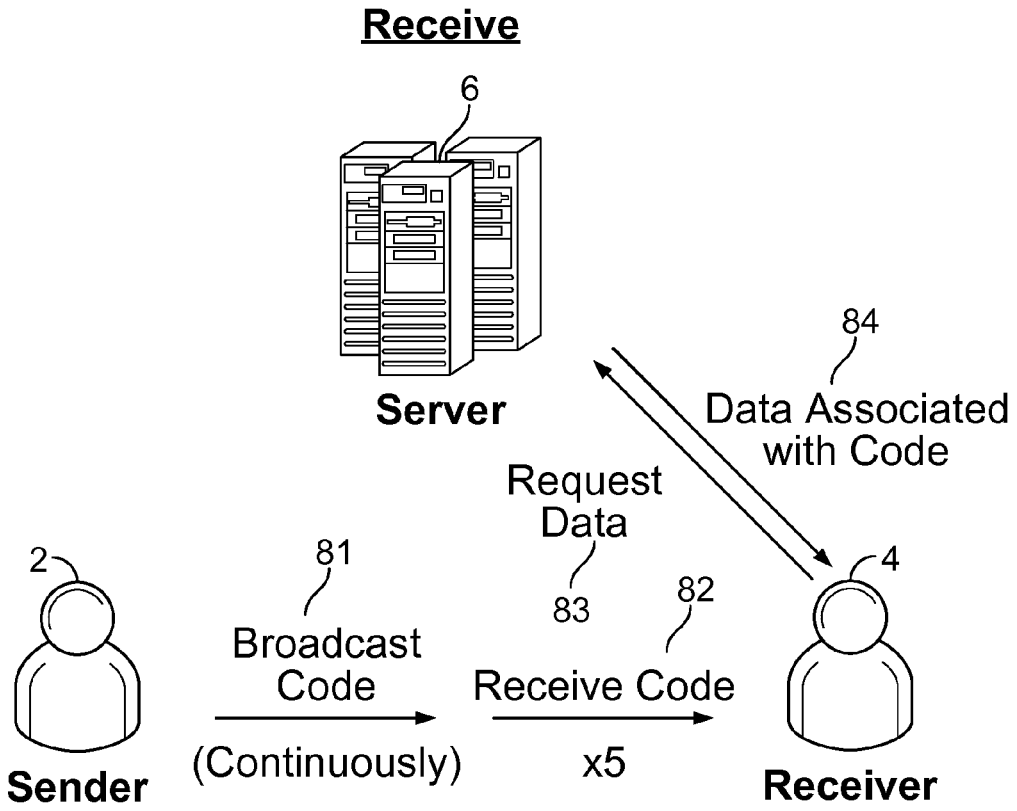

Referring to FIG. 2C, during the receive phase, the receiver 4 can receive the signal from the sender 2. If the receiver 4 is in-range of the identification signal, the receiver 4 can decode the signal and then recover the appropriate data from the server 6. Accordingly, when the sender 2 broadcasts its code in step 81 of FIG. 2C, the receiver 4 can receive the code in step 82 and decode it accordingly. Next, in step 83, after receiving the code from the sender 2, the receiver 4 can request data from the server 6. In step 84, the server 6 can deliver the data associated with the code to the receiver 4.

According to the steps set forth above, the sender 2 does not typically transmit sensitive data directly to the receiver 4. Instead, the short-range wireless communication is used between the sender 2 and receiver 4 only to properly identify the sender 2 to the receiver 4. The exchange of any sensitive information, such as financial transaction information, can be securely transmitted from the sender 2 to the server 6 and then from the server 6 to the receiver 4.

Figure 2D:
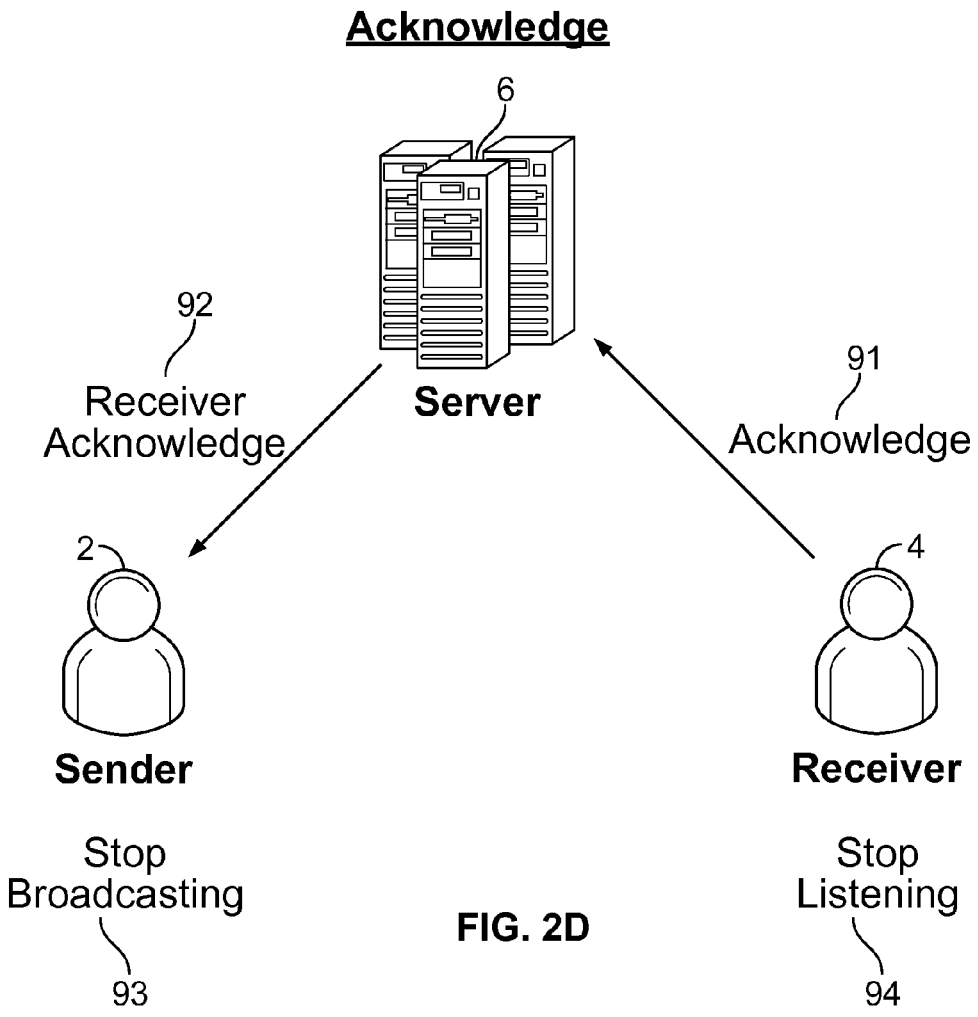

Referring to FIG. 2D, during the acknowledgement phase, the receiver 4 can acknowledge that it has received the relevant data. Typically, the receiver 4 uses an out-of-band channel for the acknowledgement phase (the channel is different from the channel on which the sender 2 broadcasts its identification information). Accordingly, after primary data reception is complete, the receiver 4 initiates the acknowledgement phase, during which the receiver 4 sends an acknowledgement signal to the server 6 during step 91. The server 6 then sends the receiver acknowledgement to the sender 2 in step 92. In step 93, the sender 2 may stop or continue broadcasting its identification signal, and in step 94, the receiver 4 may stop or continue listening for the identification signal. In some embodiments, the sender 2 will continue to broadcast its code until receiving the acknowledgement signal from the server 6, at which point all communication ceases. In other embodiments, the sender 2 will continue to broadcast its code even after receiving the acknowledgement signal from the server 6.

Referring again to the setup phase shown in FIG. 2A, the sender 2 and receiver 4 synchronize on the allowable codes to be used for the communication. In addition, the sender 2 and receiver 4 agree upon the corresponding echo delays and allowable codes by point-to-point communication with the server 6. In one embodiment, the default transmission protocol transmits an integer code using echo delay encoding of ultrasonic waves in the 19 kHz-21 kHz band. At the time of transmission, the sender 2 generates a random noise profile stream and emits this profile through a band-pass filter permitting 19 kHz-21 kHz. After a time delay d=c+1 milliseconds has elapsed, where c is a store specific encoding delay, the same noise profile is added to the output. Simultaneously, the receiver 4 buffers up to 500 milliseconds of microphone input sampled at 44.1 kHz and computes the peaks of the convolution of the signal with itself. The time delay d' of the first peak after 0 ms is regarded as the received code. To expand beyond the simple 1-to-1 mapping of delay to sender identification a tree-based algorithm may be implemented where each one of x unique signals may specify a direction through a tree of depth y to account for (x)^y possible unique sender identifiers. To account for false positives and random similarities in the noise profile, in one embodiment, the receiver 4 must receive the same code in a set number of consecutive buffer intervals before accepting the transmitted code as reliable.

The transmission protocol can also require the sender 2 and receiver 4 to have out-of-band access to an external server 6, as shown in FIGS. 2A-2D. In other embodiments, the receiver 4 need not have communication with the server 6 out-of-band during the time of the transaction with the server 6. For example, if the receiver 4 has already received the transmission protocol to be used for communication and the sender 2 also has the same protocol information, it may be possible for the receiver 4 to be used even if it does not have communication with the server 6 at the point of the transaction (such as at the point of sale). For instance, if the receiver 4 is a wireless smart phone, but it is in a location where there is not cellular service or WIFI service (both of which can typically be used for communication with the server 6), it may still be possible to perform the transaction. In one such embodiment, the sender 2 will broadcast its identification code and the receiver 4 will listen for the code, as described above. In this embodiment, instead of having the receiver 4 download data for the transaction from the server 6, the receiver 4 may send and receive transaction information directly from the sender 2 using the agreed upon protocol over the medium utilized for device recognition. The sender 2 can thereafter relay this identification and transaction information to the server 6, and this can provide authorization for the transaction. For instance, the receiver 4 may be able to provide authorization for a transaction to the server 6 through the sender 2.

In some embodiments, a method for payments from one wireless device to another is provided. For example, the sender will upload payment data to a server using an out-of-band connection while broadcasting an identification signal through a built-in speaker following an acoustic protocol over the 19 kHz-21 kHz band. As a specific example for a point-of-sale embodiment, the sending device may be used by a merchant. The sender can send to the server the amount of money that the user of the receiving device must pay for the transaction. For instance, if a good at the point of sale costs $7.55, the sender can send this amount to the server. In tandem, the receiver will detect the identification signal via its microphone, decode this signal, and request the transaction information from the server. After processing the transaction information, the receiver will send an acknowledgement signal through the server to the sender, at which point the transaction is complete. For instance, the receiver listens for the identification signal from the sender and then decodes this signal. After decoding it, the receiver sends a signal to the server to indicate that the receiver is within range of the specific sender for which the receiver has decoded the identification signal. The server may then route the sale cost information (the transaction information) to the receiver. In the specific example set forth above, for instance, the receiver will receive information indicating that the purchase will cost $7.55. The user of the receiver can acknowledge that it is OK to pay this amount to the merchant, and this will result in the receiver sending an acknowledgement signal through the server to the sender. Upon receiving this acknowledgement signal, the sender knows that the receiver has approved of the transaction and the transaction is complete. Echo delay encoding, using the delay between repetitive signals to encode identification information, may be used. Other protocols may be used. In some cases, this may result in a simple method for the user of the receiver to pay for goods at the point of sale without using cash or a credit card.

In another embodiment for payment between two wireless devices, sender uploads payment data to a server using an out-of-band connection while broadcasting an identification signal through a built in speaker following an acoustic protocol over the 19 kHz-21 kHz band. If no connection to the server can be established, communication may occur solely over the acoustic medium. In the case that connection to a server can be established, the receiver will detect the identification signal via microphone, decode it, and request the payment information from the server. After processing the payment information, the receiver will send an acknowledgement signal through the server via an out-of-band connection or directly to the sender via acoustics, at which point the transaction is complete. In some embodiments, several encoding protocols for acoustic data transfer may be used, such as utilization of a tree structure for more expansive mapping, although the primary is echo delay encoding using the delay between repetitive signals to encode identification information in a 1-1 mapping.

In some embodiments, a sender will upload data to a server using an out-of-band connection while broadcasting an identification signal over one of several mediums, including acoustic and radio (e.g., Ultrasound, Bluetooth, NFC, infrared, etc.). In addition, if no connection to the server can be established, communication may occur directly over one of the aforementioned mediums. In the case that connection to a server can be established, the receiver will detect the identification signal, decode it, and request the information from the server. After receipt of information, the receiver will send an acknowledgement signal through the server via an out-of-band connection or directly to the sender via one of the primary communication mediums, at which point the transaction is complete. In some embodiments, several encoding protocols for data transfer, with the default being echo delay encoding using the delay between repetitive signals to encode identification information in a 1-1 mapping or a tree structure providing for more expansive mapping, may be used. In some embodiments, other denser protocols when utilizing the acoustic or radio mediums may be utilized.

In some embodiments, point-to-point communication between two devices can be established that does not require direct device-to-device contact. Instead, speaker of the sender and the microphone of the receiver may enable communication between the two devices over a greater distance, such as, for example, 5 meters. In some embodiments, examples described herein do not require special hardware that is not typically present in a smart phone. For example, most smart phones are able to transmit and receive ultrasound signals. In some embodiments, enable real-time communication between two devices is enabled without requiring a lengthy binding process, which can be required for communication according to certain protocols.

Figure 3:
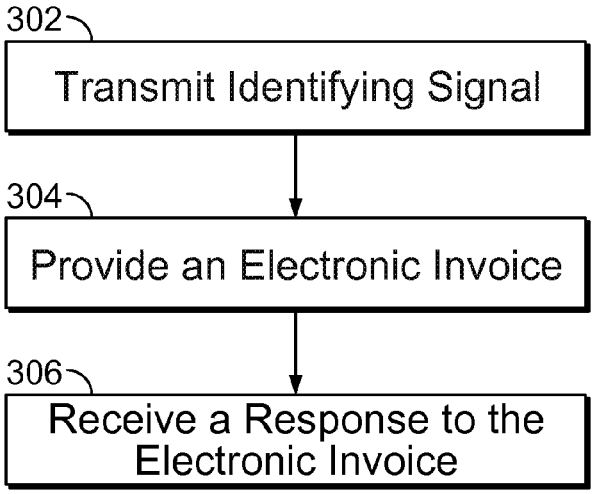
FIG. 3 is a flowchart illustrating an embodiment of a process for providing an electronic invoice.

FIG. 3 is a flowchart illustrating an embodiment of a process for providing an electronic invoice. At least a portion of the process of FIG. 3 may be implemented on terminal device 104 and/or sonic device 108 of FIG. 1A.

At 302, an identifying signal is transmitted. In some embodiments, the identifying signal is an ultrasonic signal transmitted using a speaker. In some embodiments, a device such as terminal device 104 and/or sonic device 108 of FIG. 1A uses its speaker to transmit the identifying signal. In some embodiments, the identifying signal encodes an identifier assigned a location, an account, and/or a device of a terminal device and/or a sonic device. For example, terminal device 104 and sonic device 108 of FIG. 1A are located in a retail environment and terminal device 104 generates a signal (e.g., encoding an identifier assigned to a point of sales device of the retail environment) that is transferred to sonic device 108 to be broadcasted by a speaker of sonic device 108. In some embodiments, the transmitted signal may be received by a device such as mobile device 102 of FIG. 1A to determine an identifier encoded in the signal. Using the identifier, it may be determined that the device that received signal is within the physical vicinity of a terminal device initiating a financial transaction. For example, the identifying signal is transmitted to identify that a mobile device that can be used to conduct a transaction (e.g., authorize a financial payment) is near a point of sale terminal. In some embodiments, the mobile device provides the determined identifier encoded in the signal to a server such as server 106 of FIG. 1A to allow the server to track that the mobile device is located near the terminal device of the identifier and is able to conduct a transaction with the terminal device.

At 304, an electronic invoice is provided. In some embodiments, the electronic invoice is provided via a network such network 110 of FIG. 1A. In some embodiments, providing the electronic invoice includes sending an indication of an amount desired to be received. The electronic invoice may specify one or more items to be purchased, a total amount, and/or an identifier of a merchant. In some embodiments, the electronic invoice is sent to a server that facilitates an electronic financial transaction. For example, when a clerk using a terminal device such as device 104 of FIG. 1A inputs items to be purchased into the terminal device to generate an electronic invoice, the electronic invoice is provided to the server such as server 106 by the terminal device. In some embodiments, a version of the provided electronic invoice may be forwarded by the server (e.g., the server that received the identifier provided by a mobile device receiving the identifying signal transmitted at 302) to a mobile device (e.g., device 102 of FIG. 1A) such as a mobile device that received the identifying signal transmitted at 302.

At 306, a response to the electronic invoice is received. In some embodiments, the response is provided via a network such as network 110 of FIG. 1A. In some embodiments, the response includes an authorization that confirms payment of the electronic invoice. In some embodiments, the response indicates that the electronic invoice has not been authorized. For example, a user rejects payment of the invoice and/or a user does not have sufficient funds to pay the invoice. In some embodiments, the response includes an identifier of a mobile device used to provide the payment of the electronic invoice. For example, a mobile device that received a forwarded version of the electronic invoice sent at 304 authorizes payment of the electronic invoice and the response from the mobile device is provided to a server that processes the authorization.

The server may facilitate crediting and debiting of appropriate financial accounts to complete the financial settling of the electronic invoice and provide the response received at 306.

Figure 4:
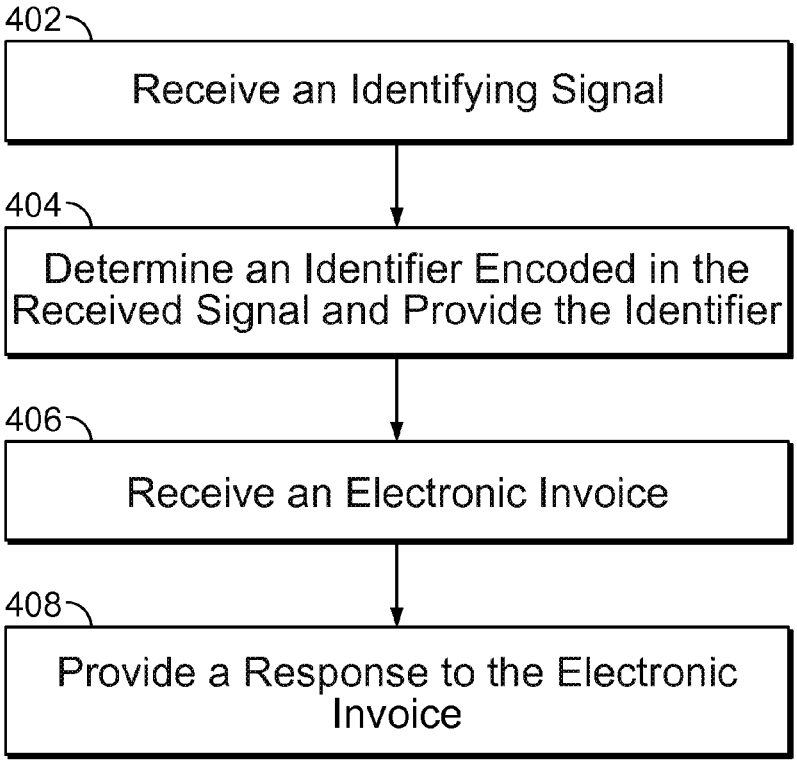
FIG. 4 is a flowchart illustrating an embodiment of a process for receiving an electronic invoice.

FIG. 4 is a flowchart illustrating an embodiment of a process for receiving an electronic invoice. At least a portion of the process of FIG. 4 may be implemented on mobile device 102 of FIG. 1A.

At 402, an identifying signal is received. In some embodiments, the identifying signal includes the identifying signal transmitted at 302 of FIG. 3. In some embodiments, the received signal is an ultrasonic signal received using a microphone. In some embodiments, a mobile device such as mobile device 102 of FIG. 1A uses its microphone to receive the identifying signal. In some embodiments, the identifying signal encodes an identifier assigned a location, an account, and/or a device of a terminal device and/or a sonic device. For example, terminal device 104 and sonic device 108 of FIG. 1A are located in a retail environment and terminal device 104 generates a signal (e.g., encoding an identifier assigned to a point of sales device of the retail environment) to be broadcasted by a speaker of sonic device 108 and received by a mobile device within the retail environment.

At 404, an identifier encoded in the received signal is determined and provided. In some embodiments, determining the identifier includes processing the received signal to determine the identifier. In some embodiments, the determined identifier is provided to a server such as server 106 of FIG. 1A to allow the server to track that the provider is located near the terminal device associated with the identifier. In some embodiments, the identifier is provided via a network such as network 110 of FIG. 1A. In some embodiments, the identifier encoded in the received signal is provided together with an identifier of a device (e.g., mobile device) providing the identifiers.

At 406, an electronic invoice is received. In some embodiments, the electronic invoice is a version of the electronic invoice provided at 304 of FIG. 3. For example, the electronic invoice may be received from the server that received the identifier provided at 404. The electronic invoice may specify one or more items to be purchased, a total amount, and/or an identifier of a sender (e.g., merchant).

At 408, a response to the electronic invoice is provided. In some embodiments, in response to the response provided at 408, the response at 306 of FIG. 3 was provided. In some embodiments, the response indicates whether to authorize payment of the invoice from an electronic account associated with a device that received the response. In some embodiments, the response indicates that the electronic invoice was sent to a device that is not a part of a transaction. For example, the electronic invoice may be sent to all mobile devices near a point of sale terminal and mobile devices not part of the transaction to be conducted may indicate that it does not desire to be a part of the transaction. In some embodiments, the response includes an authorization of payment, and a server receiving the authorization may facilitate crediting and debiting of appropriate financial accounts to complete the financial settling of the electronic invoice and provide the response received at 306 of FIG. 3.

Figure 5:
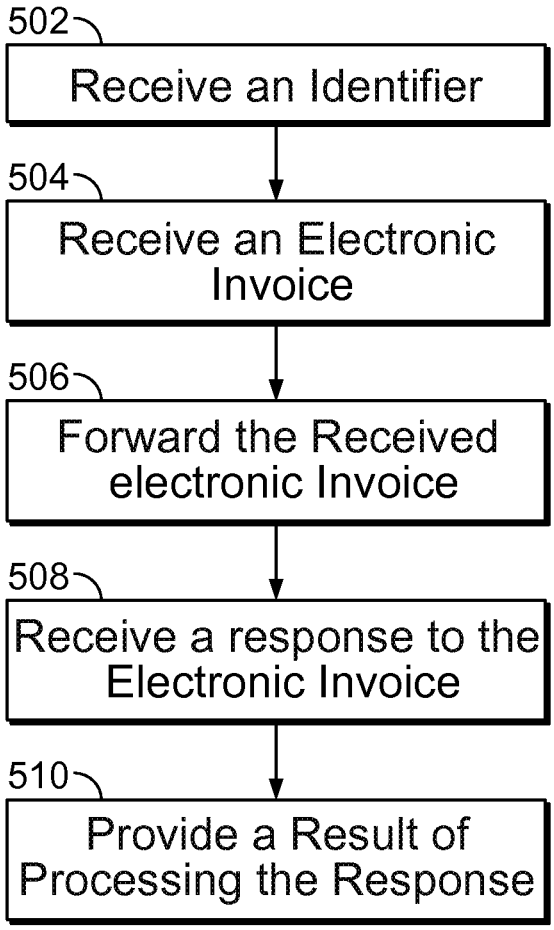
FIG. 5 is a flowchart illustrating an embodiment of a process for processing a transaction.

FIG. 5 is a flowchart illustrating an embodiment of a process for processing a transaction. At least a portion of the process of FIG. 5 may be implemented on server 106 of FIG. 1A.

At 502, an identifier is received. In some embodiments, the identifier includes the identifier sent at 404 of FIG. 4. In some embodiments, the received identifier identifies a location, an account, and/or a device of a terminal device (e.g., device 104 of FIG. 1A) and/or a sonic device (e.g., device 108 of FIG. 1A). For example, a unique identifier is assigned to each point of sale terminal that has an account with a payment settling server such as server 106 of FIG. 1A and the received identifier is one of these unique identifiers. In some embodiments, the received identifier is associated with an account of a user of a device that provided the identifier. Using the identifier, it may be determined that the device that received the signal is within the physical vicinity of a terminal device facilitating a financial transaction. For example, the received identifier is provided with a user/account identifier, and a database keeps track of which user accounts are within range of a point of sale terminal that has been assigned the received identifier. When an invoice is desired to be sent by the point of sale terminal to a device within range of the terminal, the invoice may be provided to one or more devices of the user accounts known to be within range (e.g., determined using the database) of the terminal.

At 504, an electronic invoice is received. In some embodiments, the received electronic invoice includes the invoice provided at 304 of FIG. 3. The electronic invoice may specify one or more items (e.g., goods and services) to be purchased, a total amount, and/or an identifier (e.g., identifier received at 502) of a merchant. For example, when a clerk using a terminal device such as device 104 of FIG. 1A inputs items to be purchased into the terminal device to generate an electronic invoice, the electronic invoice is provided to a server such as server 106 by the terminal device.

At 506, the received electronic invoice is forwarded. In some embodiments, forwarding the electronic invoice includes providing a version of at least a portion of the data included in the received electronic invoice to one or more (e.g., all) of mobile devices that provided the identifier received at 502. For example, an identifier associated with a merchant of the received electronic invoice is used to search a database to locate user accounts/devices indicated to be receiving an identifying signal of the identifier. A version of at least a portion of the data included in the received electronic invoice may be provided to one or more of these user accounts/devices. In some embodiments, the forwarded electronic invoice includes the electronic invoices received at 406 of FIG. 4.

In some embodiments, forwarding the electronic invoice includes providing a version of at least a portion of the data included in the received electronic invoice to one or more of mobile devices that provided the identifier received at 502 and also provided an identification that the mobile device desires to receive an electronic invoice. For example, when a mobile device provides the identifier at 502, an identification of a merchant associated with the identifier is provided to the mobile device. The mobile device is then able to indicate (e.g., via a selection of a user interface object, a touch input gesture, dragging a user interface object, shaking the mobile device, orientating the mobile device in a certain position, moving the mobile device in a certain motion, etc.) that a user of the mobile device is ready to review and respond to an electronic invoice from the identified merchant, and the electronic invoice is only provided to those mobile devices that provided the indication.

At 508, a response to the electronic invoice is received. In some embodiments, the response includes the response provided at 408 of FIG. 4. For example, the response indicates whether to authorize payment of the invoice from an electronic account associated with a device that received the response. In some embodiments, in the event the response authorizes payment of the invoice, crediting and debiting of appropriate financial accounts (e.g., credit account of a merchant logged on to a terminal device and debit from a customer logged on to a mobile device) to complete the financial settling of the electronic invoice are facilitated. In some embodiments, if a response indicating an approval to authorize the payment is received from a plurality of devices, only the first received approval is accepted and processed as an authorization. In some embodiments, if a response indicating an approval to authorize the payment is received, the electronic invoice provided to any other mobile device at 506 is cancelled and/or refracted. For example, server 106 of FIG. 1A sends a message via network 110 to all mobile devices that did not provide the accepted authorization (e.g., mobile device 102 of FIG. 1A) to cancel/retract the provided request.

At 510, a result of processing the response is provided. In some embodiments, providing the result includes providing the response received at 306 of FIG. 3. In some embodiments, the result includes a confirmation of payment of the electronic invoice. In some embodiments, the result indicates that the electronic invoice has not been authorized. For example, a rejection of the invoice is received at 508 and/or it is determined that a user does not have sufficient funds to pay the invoice. In some embodiments, the result includes an identifier of a mobile device and/or user account used to provide the payment of the electronic invoice.

Figure 6:
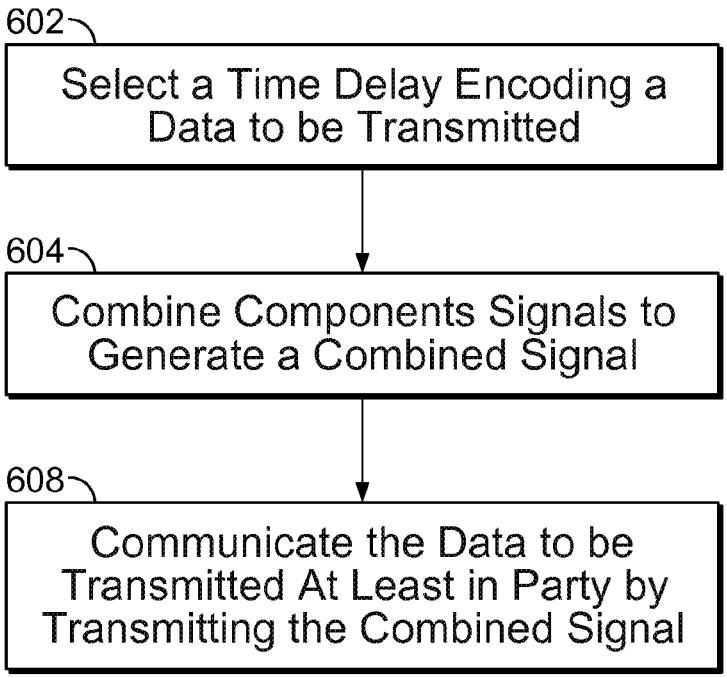
FIG. 6 is a flowchart illustrating an embodiment of a process for transmitting a sonic signal encoding data.

FIG. 6 is a flowchart illustrating an embodiment of a process for transmitting a sonic signal encoding data. The process of FIG. 6 may be at least in part implemented on terminal device 104 and/or sonic device 108 of FIG. 1A. In some embodiments, at least a portion of the process of FIG. 6 is included in step 302 of FIG. 3. For example, the identifying signal transmitted in step 302 of FIG. 3 is generated and transmitted using at least a portion of the process of FIG. 6.

At 602, a time delay encoding a data to be transmitted is selected. In some embodiments, the data to be transmitted includes an identifier of a merchant at a specific location. For example the identifier to be transmitted identifies a location, an account, and/or a device associated with a point of sale device (e.g., terminal device 104 and/or a sonic device 108 of FIG. 1A) located in a commercial environment. The identifier may be broadcasted constantly, periodically, and or dynamically (e.g., when transaction is initiated) to allow any mobile device that is close enough to detect the broadcasted identifier to be able to uniquely identify the merchant/device that can be used to perform a transaction (e.g., retail transaction). For example, an electronic payment application configured on a mobile device detects an identifier of a merchant and/or point of sale device whenever the mobile device is near a point of sale location where an electronic payment can be made using the electronic payment application to purchase a good/service.

In some embodiments, by adjusting a difference in delays of the same component signal that been staggered in time and combined together, data is encoded in the combined signal. For example, in order to encoded the integer "1," two copies of the same component signal are offset by 1 ms and combined together, and in order to encoded the integer "2," two copies of the same component signal are offset by 1 ms and combined together. In some embodiments, the component signals to be combined include a white noise signal. For example, terminal device 104 of FIG. 1A includes a signal buffer and the signal buffer is stored with a white noise signal that includes a signal of random frequencies over an ultrasonic frequency range for a pre-determined period of time. The use of white noise signals in the data transfer scheme may help reduce the effects of ambient noise in noise environments. In some embodiments, by using white noise randomly generated over as many frequencies as possible within a particular ultrasonic frequency band, the effect of ambient noise at certain frequencies is muted. Other examples of the component signal include a pseudo-random binary sequence and Walsh-Hadamard code. In some embodiments, the component signal and the combined signal to be transmitted are within the ultrasonic frequency range to allow the transmission and detection of the signal using a speaker and a microphone (e.g., relatively inexpensive components already present in many devices including mobile devices).

In some embodiments, integers are encoded in a combined signal to be transmitted by staggering the outputting of component signals between a plurality of buffers storing the same component signals. In some embodiments, when the last sample of white noise stored in a buffer is outputted, an additional white noise signal is generated and stored in the buffer for the seamless outputting of white noise from the buffer. In one example embodiment, each buffer can store 4096 white noise samples lasting a cumulative 93 milliseconds. In some embodiments, data is encoded in the component signal to be transmitted by staggering the same component signal from multiple buffers by a pre-determined amount of delay time. The same component signal is generated and stored in, for example, two different buffers. In some embodiments, the component signal is transmitted from the first buffer, and can (for instance) be transmitted from the second buffer 1 ms later (e.g., "buffer delay"). In some embodiments, the component signal is written to the second buffer with 1 ms of silence or other noise before the beginning of the white noise signal.

Figure 7A:
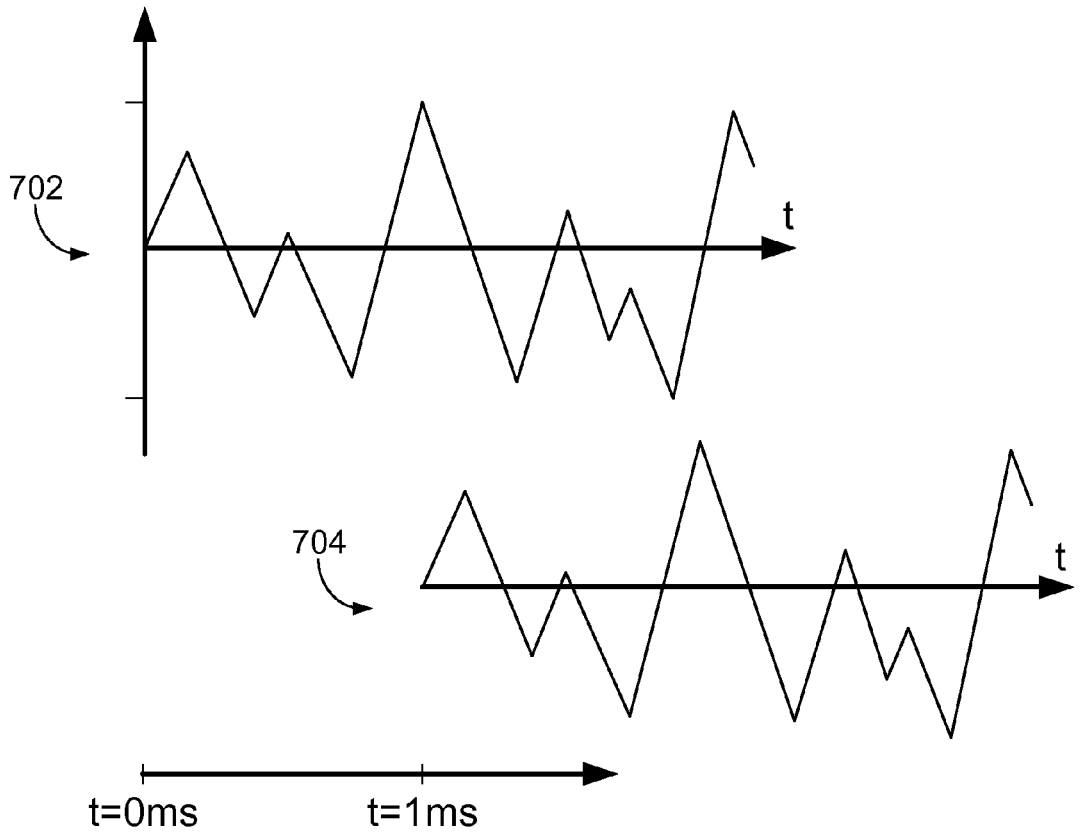
FIG. 7A is a diagram illustrating example signals of two component signals with a 1 ms delay to encode an integer "1" as a 1 ms delay.

FIG. 7A is a diagram illustrating example signals of two component signals with a 1 ms delay to encode an integer "1" as a 1 ms delay. FIG. 7A shows first component signal 702 and second component signal 704 that is delayed from first component signal 702 by 1 ms. First component signal 702 and the delayed second component signal 704 may be combined together to form a combined signal to be transmitted.

To encode an integer a specific delay correlating to the integer is selected. For example, a delay of 1 millisecond between component signals can correlate with the integer "1," a delay of 2 milliseconds can correlate with the integer "2," and so on. A device such as mobile device 102 of FIG. 1A may capture the outputted combined signal to identify the delay between the signals by autocorrelating the received signal. The device may then identify the data corresponding to the determined delay. In some embodiments, the amount of data capable of being encoded is limited by a maximum buffer delay, selected to improve system performance and to increase robustness to ambient noise. In one embodiment, the maximum buffer delay is 50 ms corresponding to a capacity of encoding 50 integers.

To increase the amount of data that can be encoded, the delays can vary by smaller increments of time than 1 ms (e.g., "delay intervals"). For example, delays can vary by 0.4 ms, or 0.1 ms. For example, a delay of 1 ms can correlate with the number "1," a delay of 1.1 ms can correlate with the number "2," and so forth. However, as the buffer delay intervals narrow, the ability of a receiver to distinguish between delays may decrease. Accordingly, in some embodiments, the selection of a delay interval must account for maximizing the amount of data capable of being encoded with the component signals and ensuring that delay intervals are capable of being distinguished by a receiver. In one embodiment, a minimum delay interval of 0.555 ms is used.

In some embodiments, the amount data that can be encoded is increased using a second delay of a third component signal. For example, the component signal from a third buffer may be delayed by a second buffer delay.

Figure 7B:
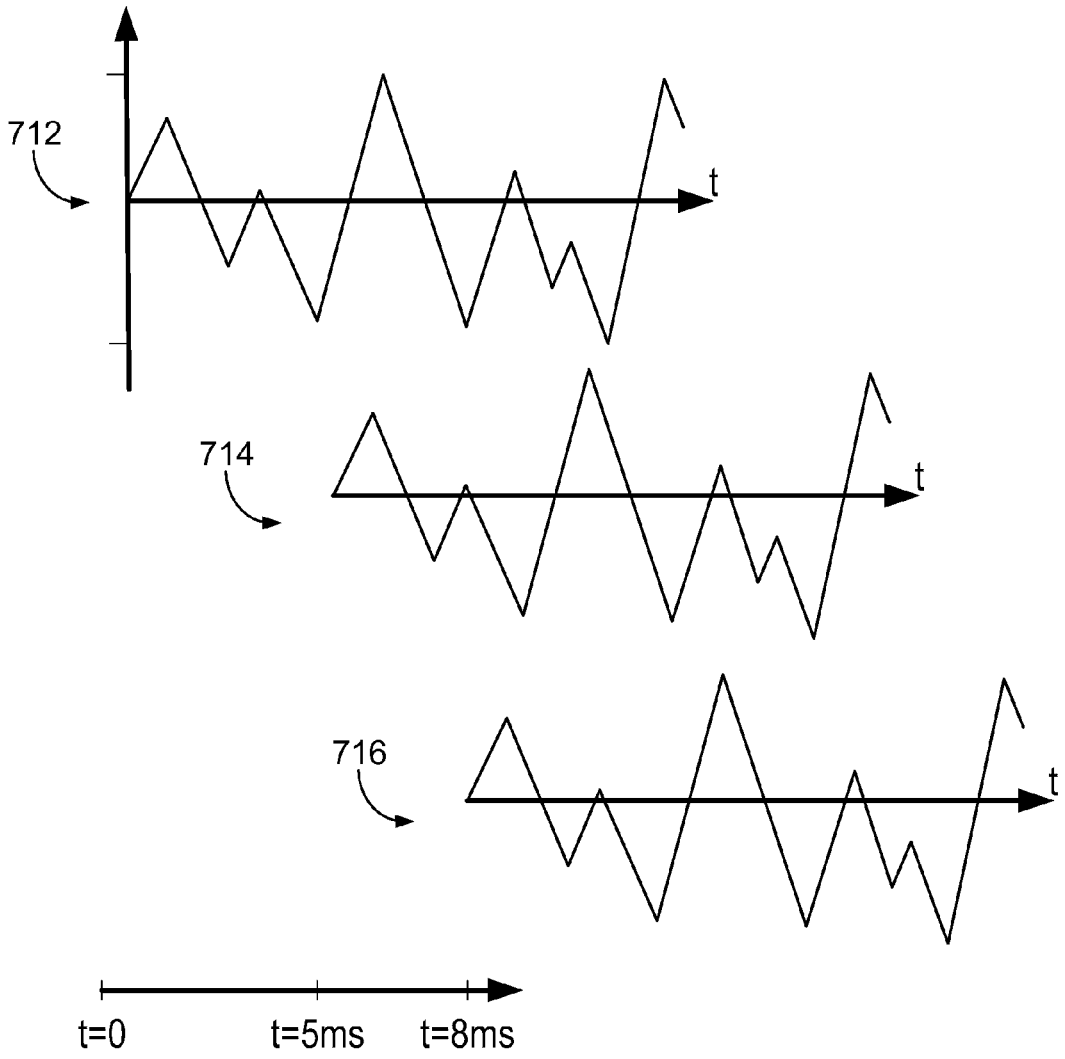
FIG. 7B is a diagram illustrating example signals of three component signals with a 5 ms delay to encode an integer "5" and a 8 ms delay to encode an integer "8".

FIG. 7B is a diagram illustrating example signals of three component signals with a 5 ms delay to encode an integer "5" and an 8 ms delay to encode an integer "8." FIG. 7B shows first component signal 712 and second component signal 714 that is delayed from first component signal 712 by 5 ms and third component signal 716 that is delayed from first component signal 712 by 8 ms. First component signal 712, the delayed second component signal 714, and the delayed third component signal may be combined together to form a combined signal to be transmitted.

In some embodiments, the two data (e.g., integer pair) that can be encoded by combining three component signals is limited in capacity. In some embodiments, the same data (e.g., integer value) cannot be chosen for both data such that it would result in the transmission of component signals with the same delay. In some embodiments, the first and second delays must be above a threshold. In some embodiments, the difference between the first and the second delays (i.e., third delay) must be above a threshold. For example, a receiver may have difficulties distinguishing delays below a threshold, and the delay cannot be selected below the threshold and the difference between the first delay and the second delay (e.g., the above-mentioned third delay) cannot be below the threshold. In one embodiment, the number of different integer pairs that can be selected is limited to 737.

In some embodiments, the amount of data that can be encoded is increased by using a plurality of frequency channels. For example, a first group of same component signals within the first frequency range (e.g., 17-19 kHz) of a first communication channel encodes a first group of data (e.g., a first integer pair) and a second group of same component signals within the second frequency range (e.g., 19 kHz-21 kHz) of a second communication channel encodes a second group of data (e.g., a second integer pair). In some embodiments, a receiver detects the delays between component signals within each frequency channel independently and identifies the data being transmitted in each channel. In the embodiment described above where 737 unique data can be transmitted within one frequency channel, 543,169 unique data can be transmitted across two frequency channels. In various embodiments, more than two frequency channels may exist.

At 604, components signals are combined to generate a combined signal. In some embodiments, combining the component signals includes adding together a component signal with a copy of the same component signal that has been delayed in time by the time delay selected at 602. In various embodiments, more than one copy of the same component signal may be delayed relative to a reference component signal and combined together to generate a combined signal. In some embodiments, combining the component signals includes combining component signals in different frequency channels to generate a combined signal with multiple frequency channels.

At 606, the data to be transmitted is communicated at least in part by transmitting the combined signal. In some embodiments, transmitting the combined signal includes outputting the combined signal using a speaker. For example, the combined signal is outputted by one or more speakers of a terminal device such as terminal device 104 of FIG. 1A and/or a sonic device such as sonic device 108 of FIG. 1A.

Figure 8:
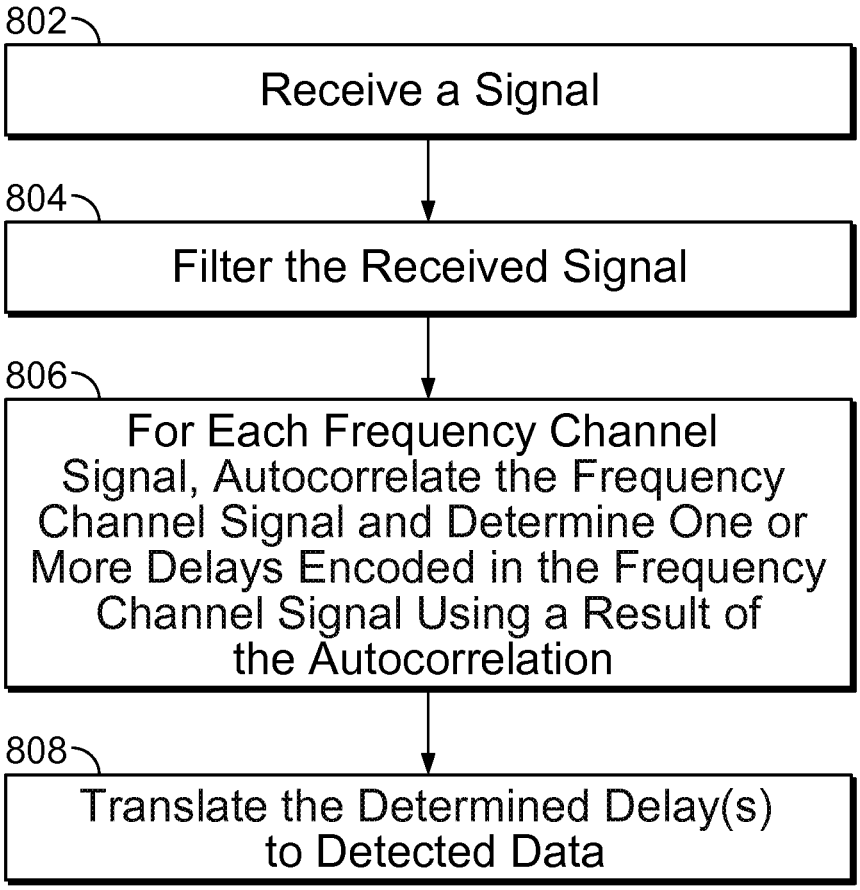
FIG. 8 is a flowchart illustrating an embodiment of a process for determining an encoded data.

FIG. 8 is a flowchart illustrating an embodiment of a process for determining an encoded data. The process of FIG. 8 may be implemented on a mobile device such as mobile device 102 of FIG. 1A. In some embodiments, at least a portion of the process of FIG. 8 is included in step 402 and/or step 404 of FIG. 4.

At 802, a signal is received. In some embodiments, the received signal includes the combined signal transmitted at 606 of FIG. 6. In some embodiments, a mobile device such as mobile device 102 of FIG. 1A monitors incoming audio via microphone to determine if an identifying signal is detected. In one embodiment, a receiver captures and stores the received signal in a buffer until the buffer is filled then analyzes the buffered signal to determine if the signal includes repeating component signals. The size of the buffer and/or a sample length of signal to be analyzed is selected such that it is greater than the maximum delay length used to encode data in the signal (e.g., larger than the largest possible delay selectable at 602 of FIG. 6). In one embodiment, the buffer length and/or signal sample size is 372 milliseconds.

At 804, the received signal is filtered. In some embodiments, filtering the signal includes using a band-pass filter to isolate the signals of each frequency channel in the received signal. For example, where the received signal includes a first communication channel with a frequency between 17-19 kHz and a second communication channel with a frequency between 19-21 kHz, a band-pass filter is applied to isolate components signals of the first communication frequency channel and isolate component signals of the second communication frequency channel.

At 806, for each frequency channel signal, the frequency channel signal is autocorrelated and one or more delays encoded in the frequency channel signal is determined using a result of the autocorrelation. The frequency channel signal may be the isolated signal of a frequency channel in the received signal. In some embodiments, autocorrelating the signal of the frequency channel includes cross-correlating (e.g., measure of similarity between signals as a function of a time-lag applied to one of the signals) the signal with itself. In some embodiments, a receiver of the received signal knows in advance the correlation between possible delays and data that can be transmitted. For example, if the sender encodes the integer "17" as a delay of 4.9 ms, the receiver knows that an identified delay of 4.9 ms correlates to the integer "17". Accordingly, the receiver analyzes the frequency channel signal by iterating through each possible delay to detect whether the frequency channel signal includes a sequence that is repeated at each known delay amount.

Figure 9A:
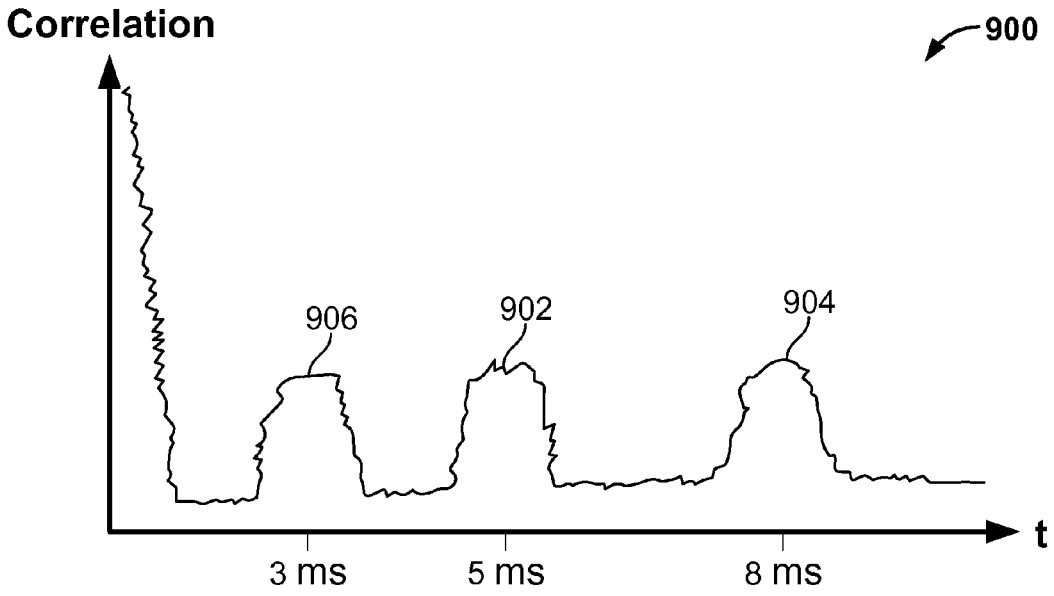
FIG. 9A is an example graph showing a result of performing autocorrelation.

FIG. 9A is an example graph showing a result of performing autocorrelation. In some embodiments, determining the delay(s) includes determining peaks (e.g., maximum correlation value above a threshold) present in a result of the autocorrelation. In some embodiments, peaks at a delay value below a threshold delay value are ignored to account for high correlation between a signal and a version of the signal that has been delayed by zero or a relatively small value. Graph 900 shows peak 902 at the first detected delay of 5 ms and peak 904 at the second detected delay of 8 ms, as well as peak 906 at the third detected delay (the difference between the first delay and the second delay) of 3 ms.

In some embodiments, after identifying peaks in the autocorrelation result (each associated with a particular delay), a check is performed to ensure that the difference between the two largest delays is equal to the smallest buffer delay (e.g., to account for the third delay resulting from adding three component signals together). If the check is not satisfied, the received signal stored in a buffer is discarded and a new signal is captured in the buffer.

In some embodiments, determining the delay(s) includes calculating the area of the curve around a small window for each detected peak of the autocorrelation result. In some embodiments, determining the delay(s) includes calculating the area of the curve around a small window for each possible delay value. In one embodiment, the area of the curve around the center of the window is weighted more heavily than the area under the curve near the window edges. For example, a Gaussian weighting curve can be used.

Figure 9B:
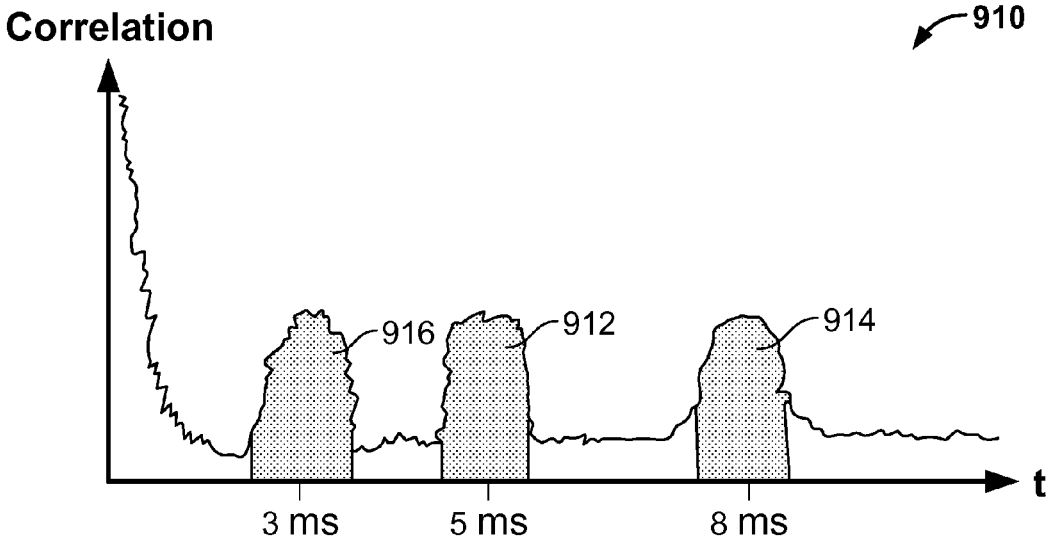
FIG. 9B is an example graph showing a shading of areas under the curve for each detected delay value.

FIG. 9B is an example graph showing a shading of areas under the curve for each detected delay value. Graph 910 shows area 912 associated with the first detected delay of 5 ms and area 914 associated with the second detected delay of 8 ms, as well as area 916 associated with the third detected delay (the difference between the first delay and the second delay) of 3 ms.

In some embodiments, if it is determined that the areas under the curve at one or more identified delays do not exceed a threshold, the received signal stored in a buffer is discarded and a new signal is captured in the buffer. In some embodiments, if it is determined that the areas under the curve at one or more identified delays do exceed a threshold, the delays are identified as being associated with detected data.

At 808, the determined delay(s) are translated to detected data. In some embodiments, delay(s) for each frequency channel is translated to data independently from other frequency channels. In some embodiments, delays for all frequency channels are translated together to determine the detected data. In some embodiments, translating the delay(s) includes using a formula/function that utilizes one or more of the determined delays as input(s) to output the data encoded in the received signal. In some embodiments, translating the delay(s) includes using a lookup table that utilizes one or more of the determined delays as input(s) to locate a value in the table that corresponds to the data encoded in the received signal. In some embodiments, the determined data at 808 is the identifier determined at 404 of FIG. 4. The determined data may include an integer, an alphanumeric value, a character, a hexadecimal value, a binary value, floating point value, and any other type of data.

Although the foregoing embodiments have been described in some detail for purposes of clarity of understanding, the invention is not limited to the details provided. There are many alternative ways of implementing the invention. The disclosed embodiments are illustrative and not restrictive.

What is claimed is:

1. A system for communicating data, comprising:

a processor configured to:

select a selected data content to be communicated to a receiver;

select for a first frequency channel, a first time delay value that at least in part encodes the selected data content to be communicated, wherein the first time delay value is selected such that the receiver is able to translate the first time delay value to at least a portion of the selected data content to be communicated to obtain at least a portion of the selected data content to be communicated;

select for a second frequency channel, a second time delay value; and combine a first sonic signal within a first frequency range, a copy of the first sonic signal that is delayed by the selected first time delay value that at least in part encodes the selected data content to be communicated, a second sonic signal within a second frequency range, and a copy of the second sonic signal that is delayed by the second time delay value to generate a combined signal; and a communication interface coupled with the processor and configured to communicate at least a portion of the selected data content at least in part by transmitting the combined signal to a mobile device.

2. The system of claim 1, wherein the data to be communicated includes an identifier of the system.

3. The system of claim 1, wherein the system includes a point of sale device.

4. The system of claim 1, wherein selecting the first time delay value includes determining the first time delay value that corresponds to the data to be communicated.

5. The system of claim 1, wherein the first sonic signal includes a white noise signal.

6. The system of claim 1, wherein the first sonic signal includes a pseudo-random binary sequence.

7. The system of claim 1, wherein the combined signal is an ultrasonic frequency signal.

8. The system of claim 1, wherein transmitting the combined signal includes transmitting the combined signal using a speaker.

9. The system of claim 1, wherein selecting the first time delay value includes selecting the first time delay value from a group of distinct predetermined time delays.

10. The system of claim 1, wherein the first time delay value and the second time delay value cannot be the same.

11. The system of claim 1, wherein the first time delay value and the second time delay value must be selected to be above a threshold value and a difference between the first time delay value and the second time delay value must be above the threshold value.

12. The system of claim 1, wherein at least a portion of the transmitted combined signal is configured to be autocorrelated by a receiver to determine the data to be communicated.

13. The system of claim 12, wherein determining the data to be communicated includes determining that an area under a curve of a result of the autocorrelation meets a threshold.

14. A method for communicating data, comprising:

selecting a selected data content to be communicated to a receiver;

selecting for a first frequency channel, a first time delay value that at least in part encodes the selected data content to be communicated, wherein the first time delay value is selected such that the receiver is able to translate the first time delay value to at least a portion of the selected data content to be communicated to obtain at least a portion of the selected data content to be communicated;

selecting for a second frequency channel, a second time delay value;

combining a first sonic signal within a first frequency range, a copy of the first sonic signal that is delayed by the selected first time delay value that at least in part encodes the selected data content to be communicated, a second sonic signal within a second frequency range, and a copy of the second sonic signal that is delayed by the second time delay value to generate a combined signal; and using a communication interface to communicate the selected data content at least in part by transmitting the combined signal to a mobile device.

15. A computer program product for communicating data, the computer program product being embodied in a non-transitory computer readable information recording medium and comprising computer instructions for:

selecting a selected data content to be communicated to a receiver;

selecting for a first frequency channel, a first time delay value that at least in part encodes the selected data content to be communicated, wherein the first time delay value is selected such that the receiver is able to translate the first time delay value to at least a portion of the selected data content to be communicated to obtain at least a portion of the selected data content to be communicated;

selecting for a second frequency channel, a second time delay value;

combining a first sonic signal within a first frequency range, a copy of the first sonic signal that is delayed by the selected first time delay value that at least in part encodes the selected data content to be communicated, a second sonic signal within a second frequency range, and a copy of the second sonic signal that is delayed by the second time delay value to generate a combined signal; and communicating the selected data content at least in part by transmitting the combined signal to a mobile device.

16. The method of claim 14, wherein at least a portion of the method is performed by a point of sale device.

17. The method of claim 14, wherein transmitting the combined signal includes transmitting the combined signal using a speaker.

18. The method of claim 14, wherein the combined signal is an ultrasonic frequency signal.

19. The computer program product of claim 15, wherein transmitting the combined signal includes transmitting the combined signal using a speaker.

20. The computer program product of claim 15, wherein the combined signal is an ultrasonic frequency signal.

* * * * *